US009874049B1

(12) United States Patent
McGregor et al.

(10) Patent No.: US 9,874,049 B1
(45) Date of Patent: Jan. 23, 2018

(54) COMPACT HINGE APPARATUS AND METHOD OF USE

(71) Applicant: Hardware Resources, Inc., Bossier City, LA (US)

(72) Inventors: Dennis McGregor, Dallas, TX (US); Travis McElveen, Bossier City, LA (US)

(73) Assignee: Hardware Resources, Inc., Bossier, LA (US)

( * ) Notice: Subject to any disclaimer, the term of this patent is extended or adjusted under 35 U.S.C. 154(b) by 0 days.

(21) Appl. No.: 15/234,492

(22) Filed: Aug. 11, 2016

(51) Int. Cl.

| | |
|---|---|
| ***E05D 7/00*** | (2006.01) |
| ***E05F 1/08*** | (2006.01) |
| ***E05F 3/20*** | (2006.01) |
| ***E05D 5/06*** | (2006.01) |
| ***E05D 7/04*** | (2006.01) |

(52) U.S. Cl.
CPC ..... *E05F 3/20* (2013.01); *E05D 5/065* (2013.01); *E05D 7/0423* (2013.01); *E05D 2007/0476* (2013.01); *E05D 2007/0492* (2013.01)

(58) Field of Classification Search
CPC ..... E05Y 2900/20; E05Y 2900/202; E05Y 2900/204; E05Y 2900/208; E05Y 2201/20; E05Y 2201/21; E05Y 2201/256; E05Y 2201/264; E05Y 2201/266; E05Y 2201/638; E05F 5/006; E05F 5/02; E05F 5/10; E05F 5/027; E05F 3/20; E05D 11/1021; E05D 11/1042; E05D 11/105; E05D 11/1064; E05D 7/04; E05D 7/0407; E05D 7/0423; E05D 7/0054; E05D 7/125; E05D 3/142; E05D 5/065; E05D 2007/0476; E05D 2007/0492; Y10T 16/5383; Y10T 16/304; Y10T 16/54029
See application file for complete search history.

(56) References Cited

U.S. PATENT DOCUMENTS

| | | | |
|---|---|---|---|
| D523,323 | S | 6/2006 | Domenig et al. |
| 7,516,516 | B2 | 4/2009 | Wu |
| 7,810,212 | B2 | 10/2010 | Salice |
| 7,966,696 | B2 | 6/2011 | Krammer |
| 8,387,213 | B2 | 3/2013 | Brunnmayr |

(Continued)

OTHER PUBLICATIONS

"Blum Compact Face Frame Hinge with Blumotion 1 ¼" Overlay Pair," amazon.com, Oct. 2, 2012. http://www.amazon.com/BlumCompactFrameBlumotionOverlay/dp/B009KJYQHK/ref=sr_1_9?ie=UTF8&qid=1452690012&sr=89&.

*Primary Examiner* — Chuck Mah
(74) *Attorney, Agent, or Firm* — Schultz & Associates, P.C.

(57) ABSTRACT

Disclosed is a self-closing, soft-close compact hinge comprising of a hinge cup pivotally connected to a hinge body via a hinge arm. A coil spring wrapped around the hinge cup provides the self-closing functionality and biases the hinge to a closed position. A damper is contained within the hinge cup in the path of the swinging hinge arm and guided by a damper cover fixedly attached to the hinge cup. The hinge body is comprised of three separate plates adjustably connected to each other with cam screws. The position of the hinge body with respect to the hinge arm is adjustable in three directions without the need for removal or loosening of mounting hardware used to attach the hinge body to a furniture piece.

20 Claims, 8 Drawing Sheets

(56) References Cited

U.S. PATENT DOCUMENTS

| | | | | |
|---|---|---|---|---|
| 8,561,262 | B1 * | 10/2013 | Liang | E05F 5/006 16/286 |
| 8,650,711 | B1 | 2/2014 | Chen et al. | |
| 8,925,151 | B2 | 1/2015 | Salice | |
| 9,003,605 | B2 | 4/2015 | Pecar et al. | |
| 9,057,214 | B2 * | 6/2015 | Salice | E05F 5/006 |
| 9,163,447 | B1 | 10/2015 | Liang et al. | |
| 2006/0137139 | A1 * | 6/2006 | Wu | E05D 7/0415 16/236 |
| 2012/0180262 | A1 * | 7/2012 | Zimmer | E05F 5/006 16/319 |
| 2013/0000075 | A1 * | 1/2013 | Forster | E05F 5/006 16/84 |
| 2013/0145580 | A1 * | 6/2013 | Brunnmayr | E05F 5/006 16/277 |
| 2013/0160242 | A1 * | 6/2013 | Brunnmayr | E05F 5/006 16/286 |
| 2014/0150204 | A1 | 6/2014 | Grummett et al. | |
| 2014/0352111 | A1 * | 12/2014 | Ng | E05F 5/02 16/286 |
| 2014/0359973 | A1 | 12/2014 | Ng | |
| 2014/0373309 | A1 | 12/2014 | Ng | |
| 2015/0240543 | A1 | 8/2015 | Ng | |
| 2015/0315832 | A1 | 11/2015 | Wu | |
| 2015/0330128 | A1 | 11/2015 | Ng | |
| 2015/0337577 | A1 * | 11/2015 | Peer | E05D 3/02 312/326 |
| 2016/0032636 | A1 * | 2/2016 | Dai | E05F 5/006 16/65 |
| 2016/0138319 | A1 * | 5/2016 | Wu | E05D 3/02 16/50 |
| 2017/0107749 | A1 * | 4/2017 | McGregor | E05F 3/12 |

* cited by examiner

COMPACT HINGE APPARATUS AND METHOD OF USE

FIELD OF THE DISCLOSURE

The present disclosure relates to compact hinges for furniture products. In particular, the present disclosure relates to a compact hinge, adjustable in three directions, providing self-close and soft-close functionality.

BACKGROUND OF THE DISCLOSURE

In the field of cabinetry and mill work, a recurring problem is the uncontrolled speed at which a cabinet door closes. The typical hinged connection includes a hinge cup mounted to a furniture piece and pivotally connected to a hinge arm mounted to another furniture piece. A metal coil spring biases the metal hinge cup toward the metal hinge arm. Uncontrolled closure can result in damage to cabinetry doors create unwanted noise and premature wear of cabinet faces.

Prior art compact hinges have attempted to solve the uncontrolled closure problem unsatisfactorily with a generally combined damper and housing assembly removably fitted to the hinge cup. Such damper assemblies are prone to inadvertent or unwanted removal because they are designed to be removable. Furthermore, the damper assemblies are typically formed of plastic and so are not aesthetically pleasing. Still further, a damper assembly such as found in the prior art is bulky and requires delicate assembly which adds unnecessary expense to the manufacturing process.

Hence, there is a need for a damper for a compact hinge that is secured in the hinge cup permanently and yet is aesthetically pleasing, and easy and inexpensive to manufacture.

SUMMARY OF THE DISCLOSURE

A preferred embodiment is comprised of a hinge cup mounted in a cabinet door, a hinge body mounted to a cabinet carcass, and a hinge arm biased by a coil spring. The hinge arm connects the hinge cup to the hinge body and provides a swinging connection between the cabinet door and the cabinet carcass. A damper, comprised of a fluid filled cylinder and a piston rod extending from the cylinder, is permanently secured within the hinge cup by a metal damper cover. The damper cover is fixedly attached to the hinge cup. The damper is acted upon by an abutment section of the hinge arm. The piston rod abuts the hinge cup. The coil spring is looped around the exterior of the hinge cup while the ends abut and ride on cam surfaces on the hinge arm. The hinge body is comprised of an "L" shaped overlay plate adjustably engaged with an adjustment plate adjustably engaged with a mounting plate. Three separate cam screws provide positional adjustability of the hinge body with respect to the hinge arm in three different directions. The overlay plate and the adjustment plate each include access holes aligned with a mounting hole in the mounting plate. Mounting hardware, such as a wood screw, attaches the mounting plate to the cabinet carcass.

In use, the apparatus controls the closing speed of the cabinet door. The damper cover permanently attaches to the hinge cup and secures the cylinder within the hinge cup and adjacent the hinge arm. As the door closes, the abutment section of the hinge arm contacts the cylinder and forces the cylinder towards the back of the hinge cup, positioned and guided by the damper cover, against the bias of the piston moving through the fluid within the cylinder. Rotation of each of the cam screws separately adjusts the position of the cabinet door in a depth direction, a vertical direction, and a horizontal or "overlay" direction without removing the mounting hardware used to mount the hinge body to the cabinet carcass.

Those skilled in the art will appreciate the above-mentioned features and advantages of the disclosure together with other important aspects upon reading the detailed description that follows in conjunction with the drawings.

DETAILED DESCRIPTION

Figure 1A:
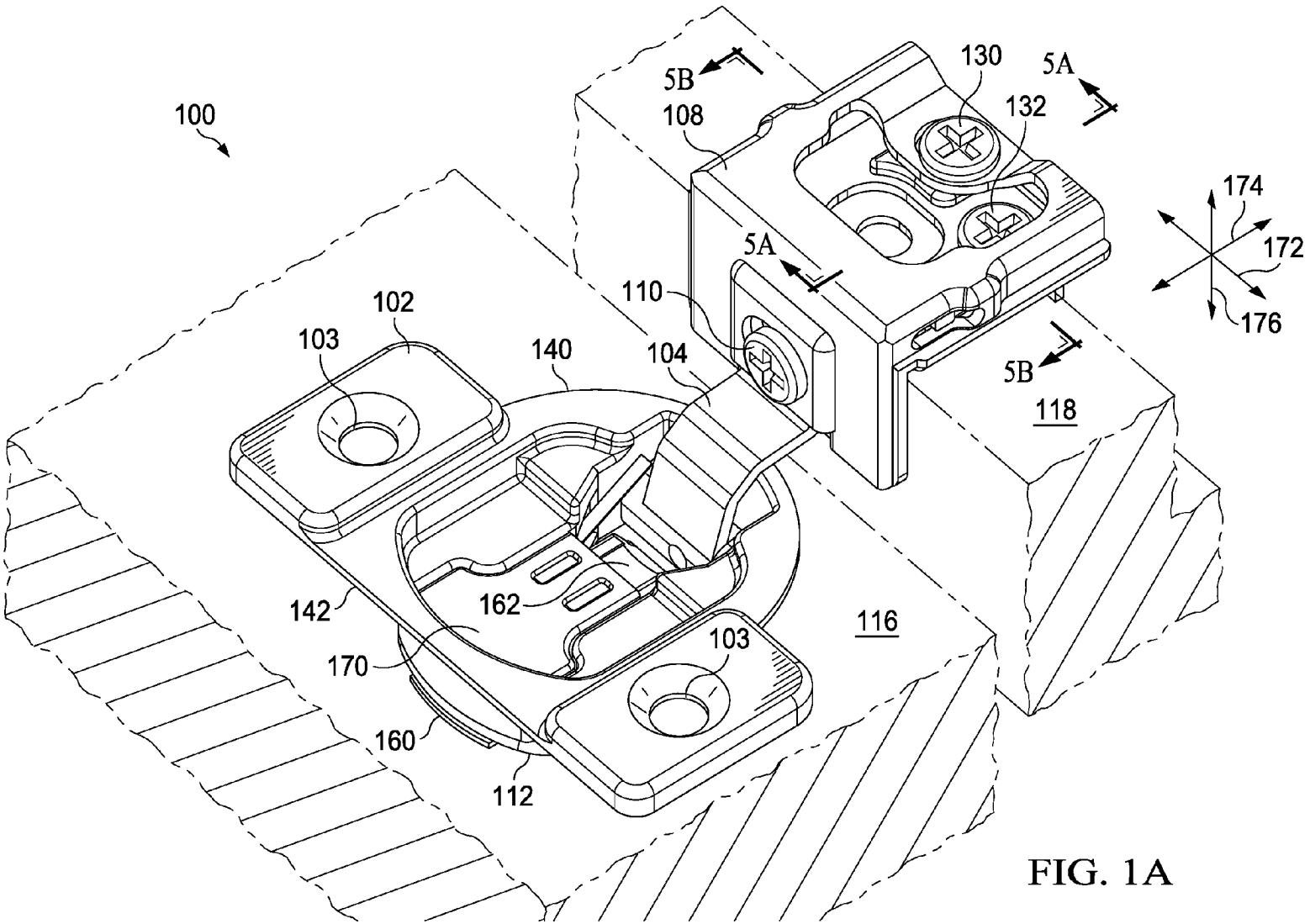
FIG. 1A is an isometric view of a preferred embodiment.

In the description that follows, like parts are marked throughout the specification and figures with the same numerals, respectively. The figures are not necessarily drawn to scale and may be shown in exaggerated or generalized form in the interest of clarity and conciseness.

Referring to FIGS. 1A-1D, hinge 100 provides a pivotal connection between cabinet door 116 and cabinet frame 118. Hinge 100 includes hinge cup 102 pivotally connected to hinge arm 104 by hinge pin 106. Hinge body 108 is adjustably connected to hinge arm 104 by overlay adjustment cam screw 110.

Hinge cup 102 has a semicircular shaped brim 140 opposite ledge 142 encompassing an indention or cup defining interior 144. Interior 144 includes at least two different horizontal surfaces, cup floor 146 and a pair of cup shelves 148 and 149. Cup floor 146 forms the base of the cup shape and is positioned between side walls 150 and 151. Side walls 150 and 151 are connected at one end by generally semicircular shaped rear wall 155. Cup shelves 148 and 149 are disposed in side walls 150 and 151, respectively and are positioned beside cup floor 146. Tab 154 extends from each side wall 150 and 151 at cup shelves 148 and 149 into interior 144. Each tab 154 is generally triangular shaped and biased in a downward orientation. Side walls 150 and 151 include spring holes 152 and 153 and hinge pin holes 156 and 157. Tab 160 extends from rear wall 155 underneath ledge 142.

Spring 112 creates a closing bias on the hinge arm. Spring 112 includes loop section 180 connected to coil sections 182 and 183. Coil sections 182 and 183 lead to spring legs 184 and 185, respectively.

Damper cover 170 is permanently connected to hinge cup 102 via engagement with tabs 154. As will be discussed in detail below, damper cover 170 secures damper 162 within interior 144 and guides movement of damper 162 along axis of movement 158. Damper 162 includes a fluid filled and spring loaded cylinder 164. Piston rod 168 extends from cylinder 164. Piston head 166 is attached to piston rod 168 within cylinder 164. The hinge arm acts on damper 162 during a closing movement to control the closing speed of the cabinet door and provide the damping function as the piston head moves through the fluid contained with the cylinder.

Typically, hinge cup 102 is affixed to cabinet door 116 with screws through holes 103 and hinge body 108 is affixed to cabinet frame 118 through slot 109. It should be noted that the orientation of the hinge cup fitted into a bore opening on a door and the hinge arm fitted on to the frame could be reversed. In a preferred embodiment, hinge cup 102, hinge arm 104, and hinge body 108 are typically constructed of metal such as cast aluminum or steel alloy plate stock and formed by stamping.

Hinge body 108 comprises overlay plate 124, adjustment plate 126, and mounting plate 128. Overlay plate 124 is adjustably connected to adjustment plate 126 by depth adjustment cam screw 130. Adjustment plate 126 is adjustably connected to mounting plate 128 by vertical adjustment cam screw 132. Each adjustment cam screw 110, 130, and 132 comprises a typical cam screw shape having a wider, cylindrical camming portion and a narrow, cylindrical offset portion extending therefrom. The separate plates of the hinge body cooperate with the adjustment cam screws to provide positional adjustment of the hinge body relative to the hinge arm in a vertical direction 172, a depth direction 174, and an overlay or horizontal direction 176.

Figure 2:
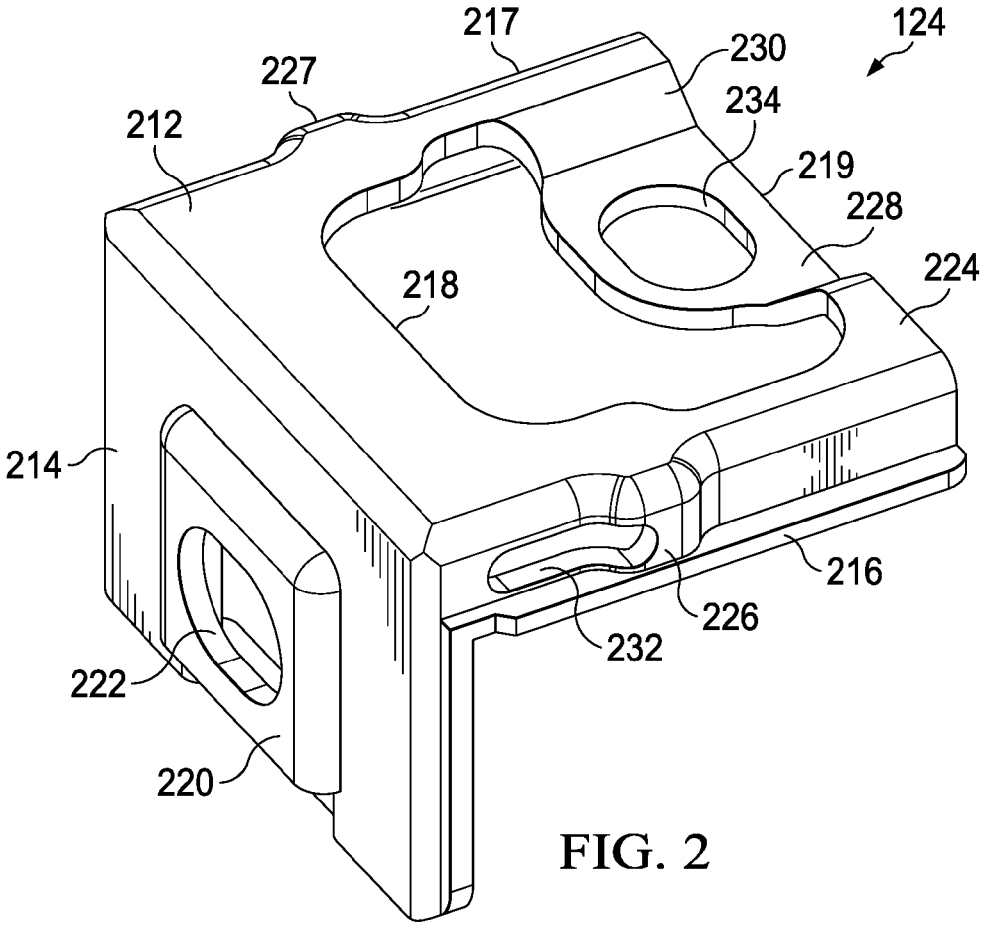
FIG. 2 is an isometric view of an overlay plate of a preferred embodiment.

Referring to FIG. 2, overlay plate 124 is generally "L" shaped comprising section 212 generally perpendicularly oriented with section 214. Section 212 is generally planar having end 219 extending between opposing sides 216 and 217. Sides 216 and 217 include sections 226 and 227 extending therefrom. Sides 216 and 217 further include slots 232 which extend along each side and which encroach on sections 226 and 227. Section 212 includes two horizontal planes with a sloping section between. Plane 224 leads to plane 228 along end 219 via slope 230. Access opening 218 is irregularly shaped and is present in both planes 224 and 228. Plane 228 includes depth adjustment slot 234. Depth adjustment slot 234 is sized to receive the camming portion of depth adjustment cam screw 130. Section 214 is generally planar and includes pocket 220. Pocket 220 is sized to receive hinge arm 104. Pocket 220 includes overlay adjustment slot 222. Overlay adjustment slot 222 is sized to receive the camming portion of overlay adjustment cam screw 110.

Figure 3:
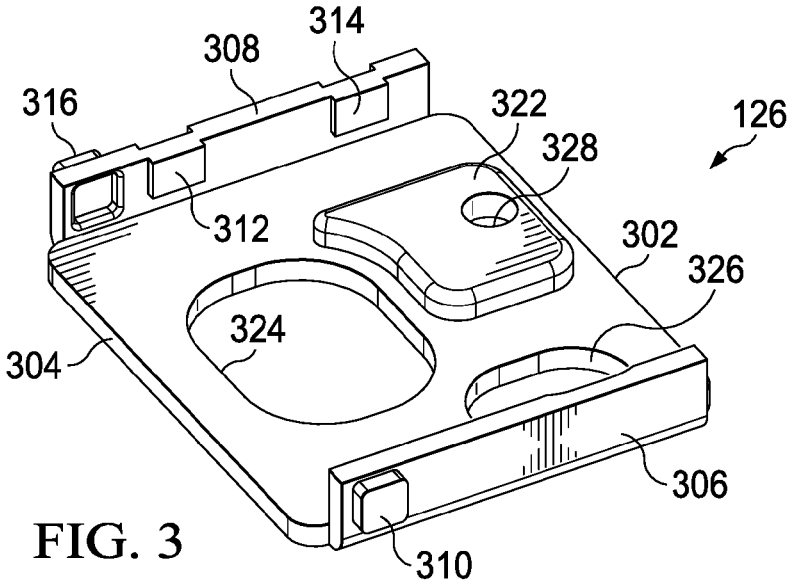
FIG. 3 is an isometric view of an adjustment plate of a preferred embodiment.

Referring to FIG. 3, adjustment plate 126 is generally planar having opposing ends 302 and 304 extending between opposing sides 306 and 308. Side 306 includes block 310 proximate end 304. Side 308 includes block 316 proximate end 304. Side 308 further includes tabs 312 and 314 extending towards side 306. Raised seat 322 extends from adjustment plate 126 proximate end 302. Raised seat 322 includes depth adjustment hole 328 generally aligned with depth adjustment slot 234. Depth adjustment hole 328 is sized to receive the offset portion of depth adjustment cam screw 130. Adjustment plate 126 defines access slot 324. Access slot 324 is aligned with a portion of access opening 218. Adjustment plate 126 further defines vertical adjustment slot 326. Vertical adjustment slot 326 is sized to receive the camming portion of vertical adjustment cam screw 132.

Figure 4:
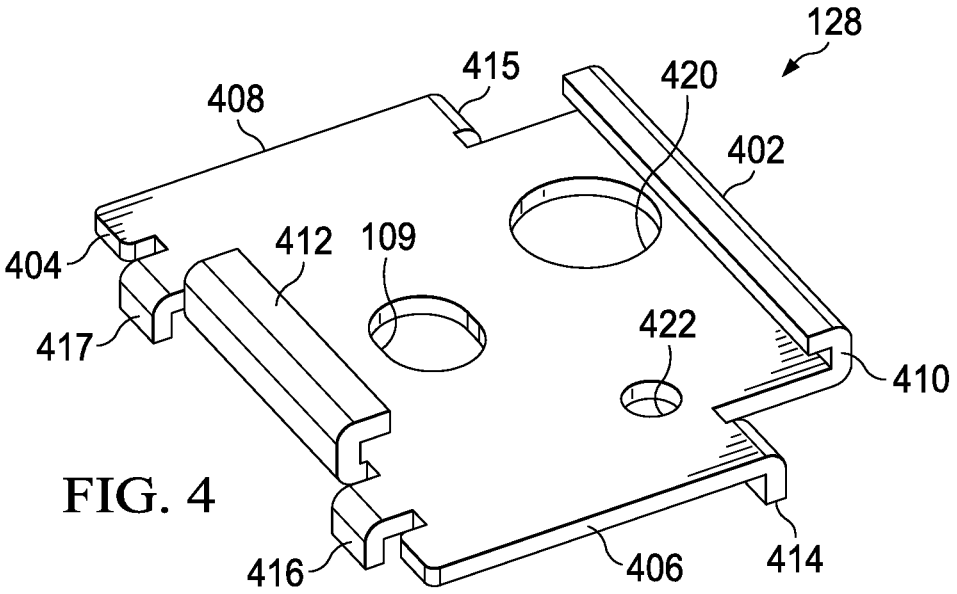
FIG. 4 is an isometric view of a mounting plate of a preferred embodiment.

Referring to FIG. 4, mounting plate 128 is generally planar having opposing ends 402 and 404 extending between opposing sides 406 and 408. End 402 includes flange 410. End 404 includes flange 412. Guide 414 extends from mounting plate 128 proximate the corner of side 406 and end 402. Guide 415 extends from mounting plate 128 proximate the corner of side 408 and end 402. Guides 414 and 415 are generally equidistant from end 404. Guide 416 extends from mounting plate 128 proximate the corner of side 406 and end 404. Guide 417 extends from mounting plate 128 proximate the corner of side 408 and end 404. Guides 416 and 417 are generally equidistant from end 402. Mounting plate 128 defines access hole 420. Access hole 420 is generally aligned with depth adjustment hole 328 to allow access to vertical adjustment screw 130 through mounting plate 128. Mounting plate 128 further defines vertical adjustment hole 422. Vertical adjustment hole is sized to receive the offset portion of vertical adjustment cam screw 132. Mounting plate 128 also defines slot 109. Slot 109 is generally aligned with access slot 324 and access hole 218 to allow access to mounting hardware (for attaching the mounting plate to the cabinet frame) through overlay plate 124 and adjustment plate 126.

Figure 5A:
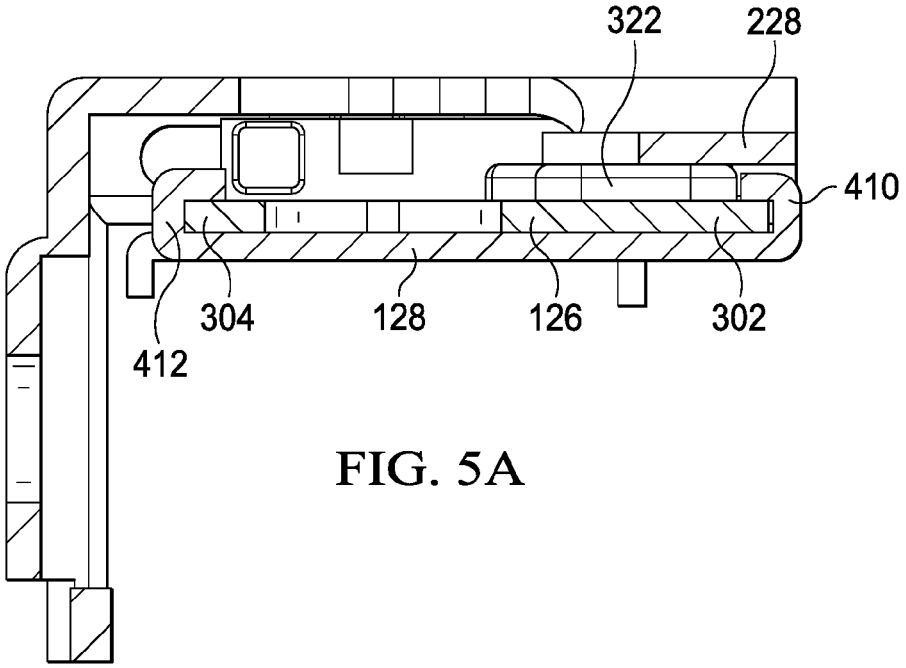
FIG. 5A is a sectional view of a hinge body of a preferred embodiment taken along line A-A of FIG. 1A.
Figure 5B:
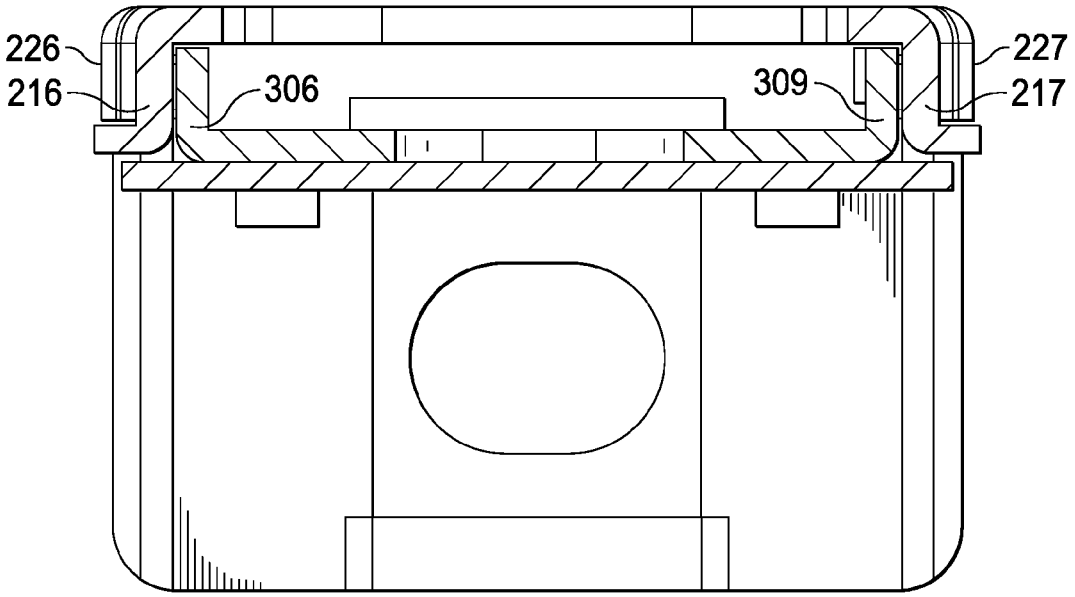
FIG. 5B is a sectional view of a hinge body of a preferred embodiment taken along line B-B of FIG. 1A.

Referring to FIGS. 5A and 5B, cross-sections of an assembled hinge body 108 are shown. Adjustment plate 126 is adjacent mounting plate 128. Ends 302 and 304 of adjustment plate 126 abut flanges 410 and 412 of mounting plate 128, respectively. Adjustment plate 126 is slidable with respect to mounting plate 128 in vertical direction 172.

Plane 228 of overlay plate 124 is adjacent raised seat 322 of adjustment plate 126. Sides 306 and 308 of adjustment plate 126 abut sides 216 and 217 of overlay plate 124, respectively. Blocks 310 and 316 slidably engage slots 232 in sides 216 and 217, respectively. Overlay plate 124 is slidable with respect to adjustment plate 126 in depth direction 174.

Figure 6:
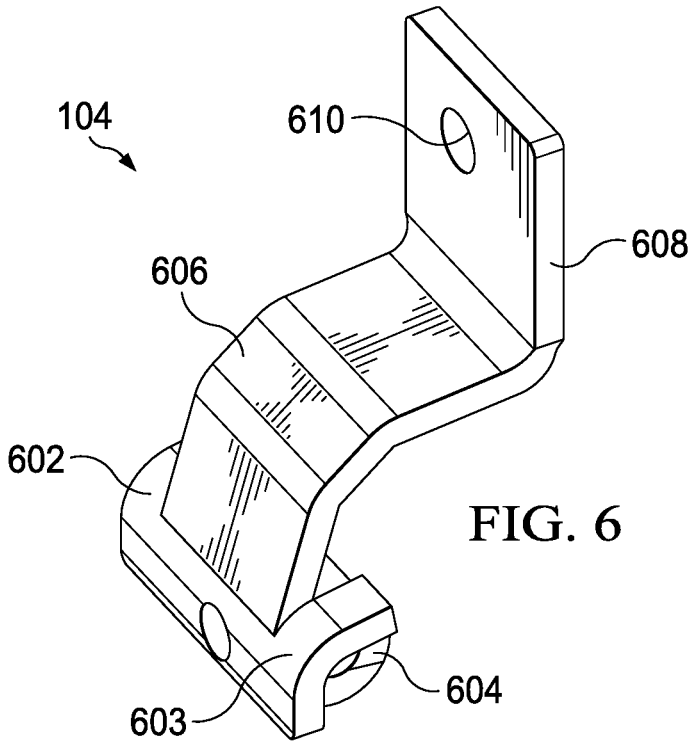
FIG. 6 is an isometric view of a hinge arm of a preferred embodiment.

Referring to FIG. 6, hinge arm 104 includes curved cam portions 602 and 603. Cylindrical sleeve 604 extends between the cam portions. Sleeve 604 is sized to receive hinge pin 106. Hinge pin 106 passes through hinge pin holes 156 and 157 in hinge cup 102 and sleeve 604 to provide a pivotal connection between hinge arm 104 and hinge cup 102. Hinge arm 104 includes abutment section 606 extending from sleeve 604. Attachment section 608 is connected to abutment section 606. Attachment section 608 defines overlay adjustment hole 610. Overlay adjustment hole 610 is aligned with overlay adjustment slot 222 and is sized to receive the offset portion of overlay adjustment cam screw 110. Attachment section 608 is generally planar and sized to slidably engage pocket 220 of overlay plate 124. Overlay plate 124 is slidable with respect to hinge arm 104 in overlay direction 176.

Figure 7A:
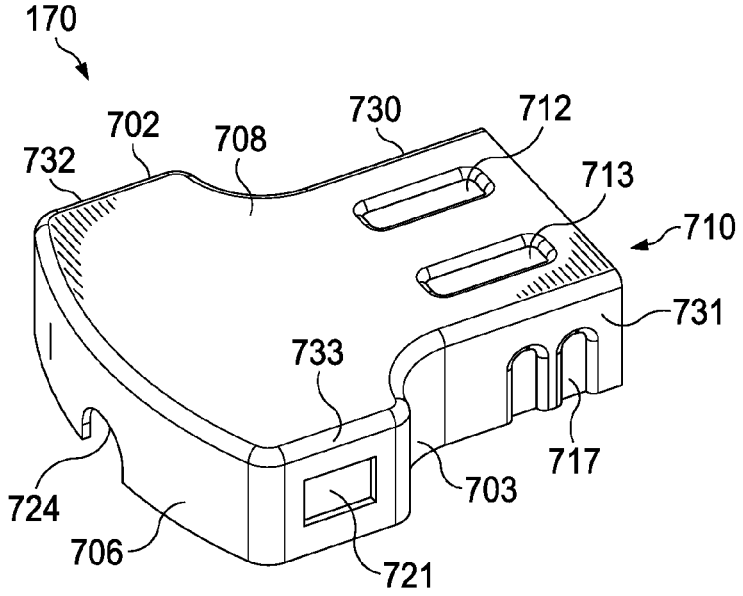
FIG. 7A is an isometric view of a damper cover of a preferred embodiment.
Figure 7B:
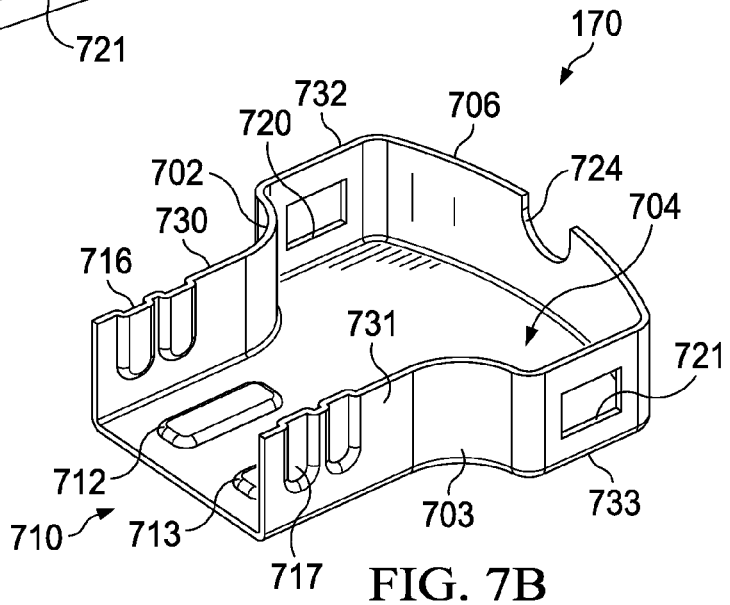
FIG. 7B is an isometric view of a damper cover of a preferred embodiment.

Referring to FIGS. 7A and 7B, damper cover 170 is shown. Damper cover 170 follows the general shape of the interior of hinge cup 102. Damper cover 170 has a generally U-shaped cross-section defined by side walls 702 and 703 connected to base 708. Rear wall 706 extends between side walls 702 and 703 and is connected to base 708 forming interior 704. Opposite rear wall 706 is opening 710. Damper cover 170 is typically stamped from 0.8 mm steel.

Side wall 702 is comprised of guide portion 730 and engagement portion 732. Guide ridges 716 are formed in guide portion 730 of side wall 702 and extend toward interior 704. Engagement portion 732 of side wall 702 includes a rectangular shaped cutout 720 sized to engage tab 154 formed in side wall 150. Side wall 703 is comprised of guide portion 731 and engagement portion 733. Guide ridges 717 are formed in guide portion 731 of side wall 703 and extend toward interior 704. Engagement portion 733 of side wall 703 includes a rectangular shaped cutout 721 sized to engage tab 154 formed in side wall 151.

Guide ridges 712 and 713 extend from base 708 toward interior 704. Guide ridges 712 and 713 are positioned between guide portions 730 and 731. Guide ridges 712 and 713 are aligned generally parallel to each other and perpendicularly with opening 710. Hole 724 is a semicircular shaped opening in rear wall 706. Hole 724 is sized to allow piston rod 168 to pass through unobstructed.

Figure 8:
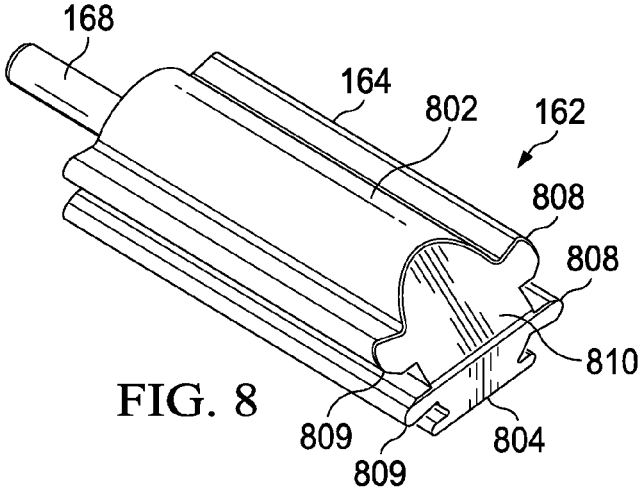
FIG. 8 is an isometric view of a damper of a preferred embodiment.

Referring to FIG. 8, damper 162 includes piston rod 168 slidable within and extending from cylinder 164. The cross-section of cylinder 164 shows a generally semicircular shaped curved surface 802 positioned opposite a generally planar surface 804. Connected between curved surface 802 and planar surface 804 are flanges 808 on one side of cylinder 164 and flanges 809 on the opposing side of cylinder 164. In between curved surface 802 and planar surface 804 and disposed opposite of piston rod 168 is angled face 810. An internal spring biases piston rod 168 out of cylinder 164 opposite angled face 810. In a preferred embodiment, cylinder 164 is typically constructed of injection molded plastic or polyvinyl chloride (PVC).

Shown assembled in FIG. 1A, damper 162 is secured into hinge cup 102 with damper cover 170. Damper cover 170 is not removable from engagement with hinge cup 102 without damage to damper cover 170 or hinge cup 102. Engagement portion 732 abuts cup shelf 148 while tab 154 in side wall 150 engages cutout 720. Engagement portion 733 abuts cup shelf 149 while tab 154 in side wall 151 engages cutout 721. Planar surface 804 of cylinder 164 rests on cup floor 146. Piston rod 168 extends through hole 724 and abuts rear wall 155 of hinge cup 102. Angled face 810 is positioned proximate hinge arm 104. Spring 112 is positioned around the exterior of rear wall 155 such that loop section 180 rests on tab 160. Coil sections 182 and 183 are positioned adjacent the exterior of both side walls 150 and 151. Spring legs 184 and 185 extend from coil sections 182 and 183 into interior 144 through spring holes 152 and 153 and abut cam portions 602 and 603.

Figure 1B:
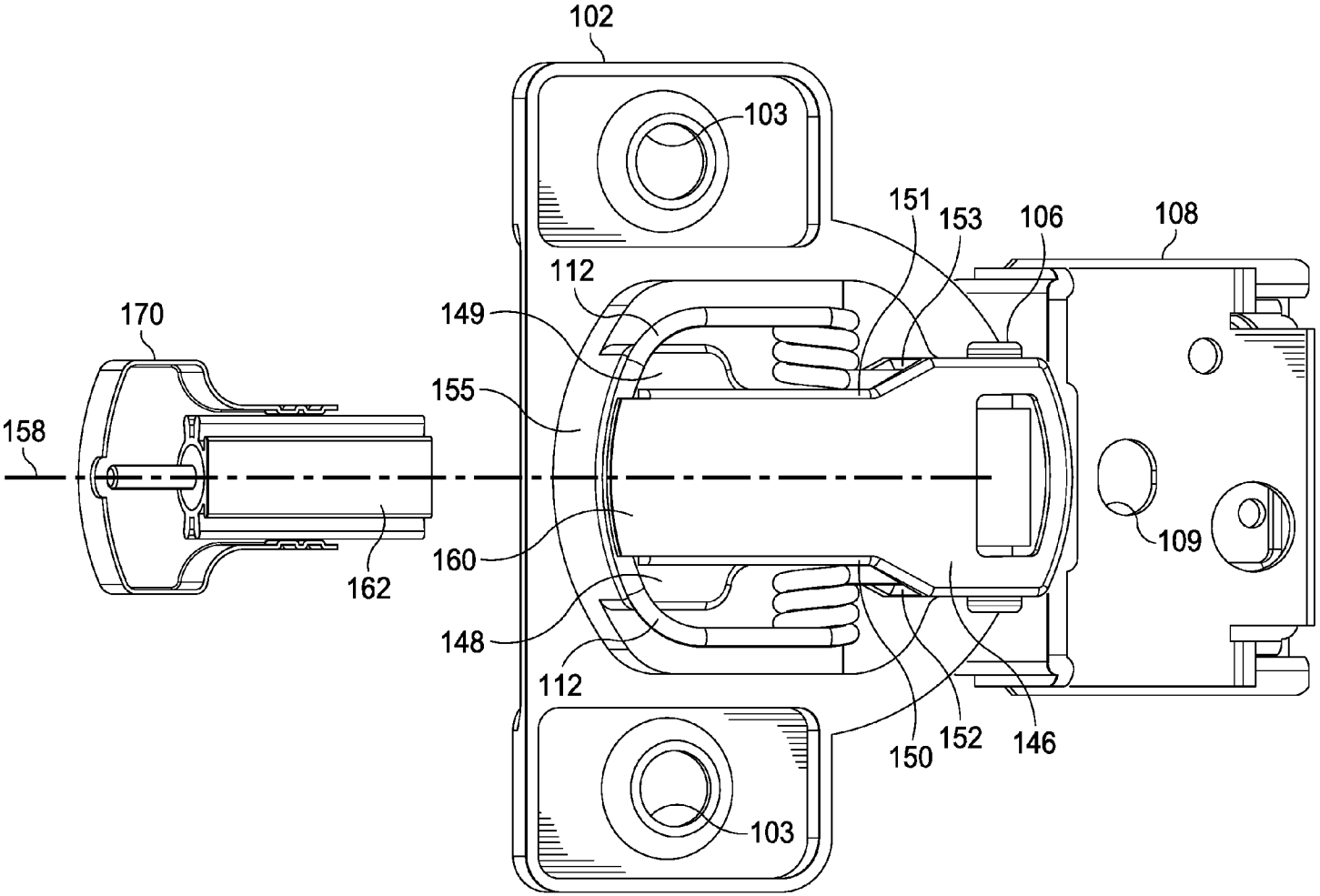
FIG. 1B is a partially exploded isometric view of a preferred embodiment.
Figure 1C:
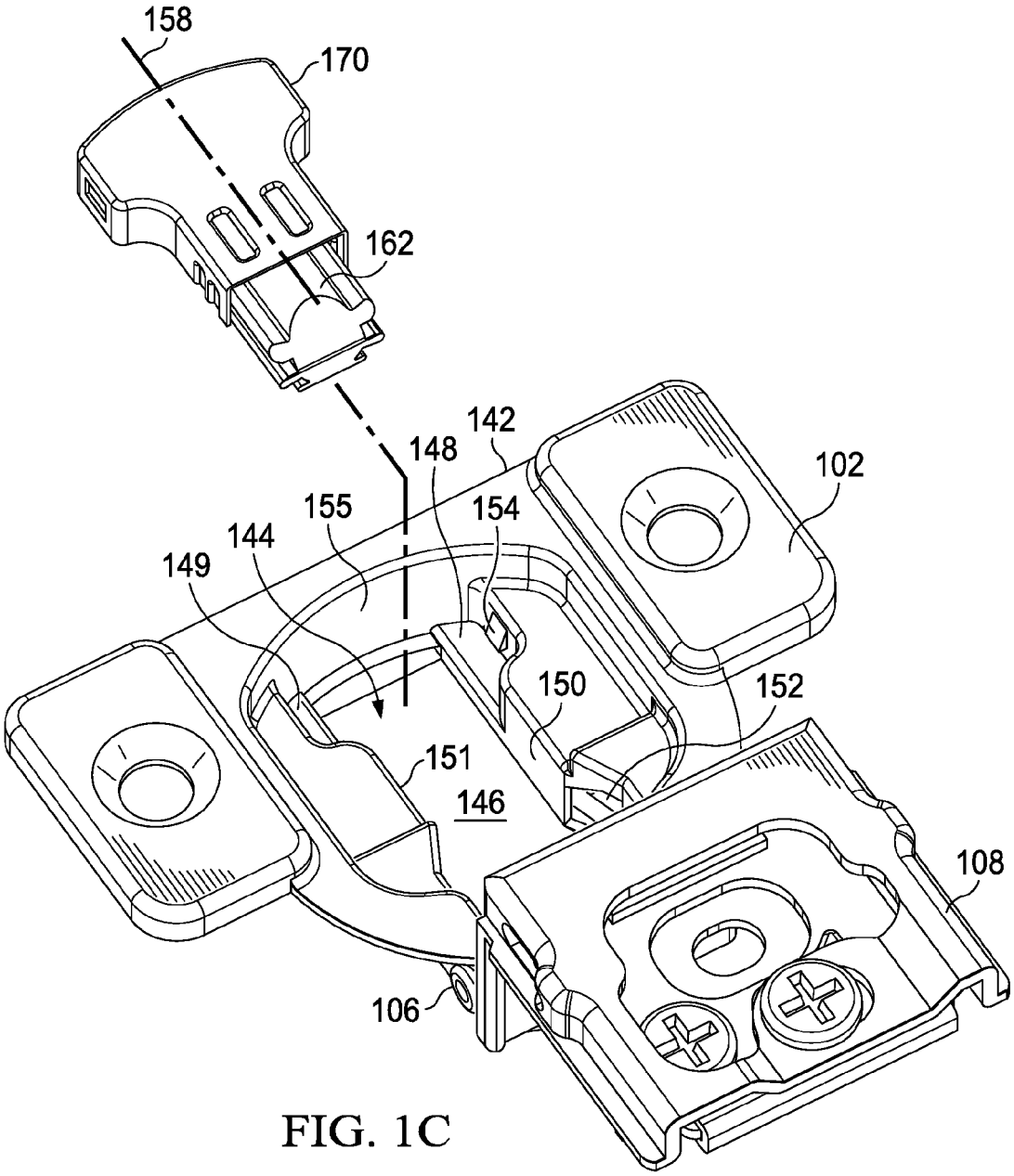
FIG. 1C is a partially exploded isometric view of a preferred embodiment.
Figure 1D:
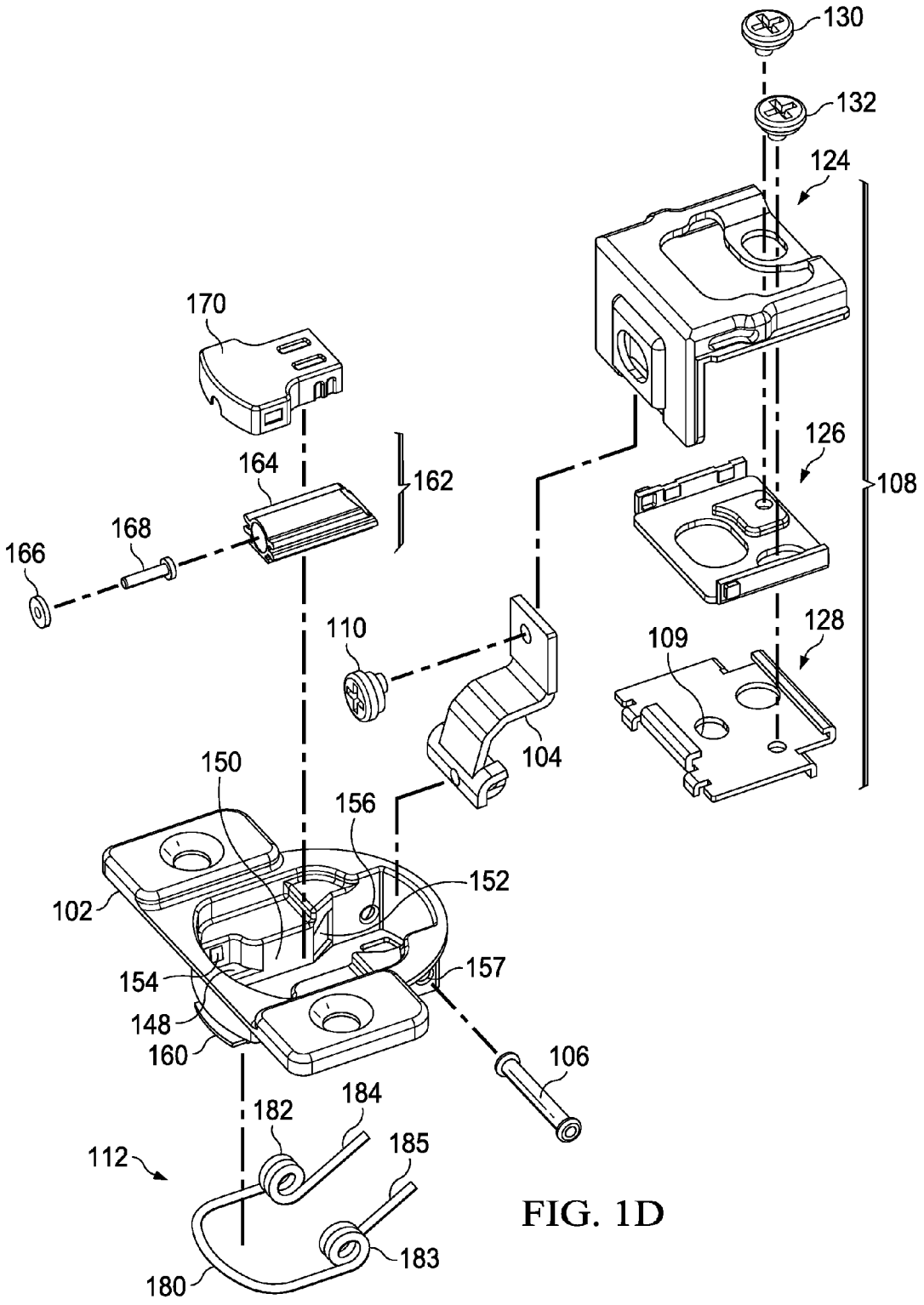
FIG. 1D is an exploded isometric view of a preferred embodiment.

As shown in FIGS. 1B and 1C, guide ridges 712, 713, 716, and 717 position and guide cylinder 164 such that linear movement of cylinder 164 follows axis 158. Curved surface 802 of cylinder 164 abuts guide ridges 712 and 713 and flanges 808 and 809 abut guide ridges 716 and 717, respectively.

In use, hinge 100 provides a pivotal connection between cabinet door 116 and cabinet frame 118. Hinge cup 102 is mounted in a bore in the cabinet door through holes 103 and hinge body 108 is mounted to the cabinet frame through slot 109 with typical mounting hardware such as wood screws. Hand tools gain access to slot 109 via access opening 218 and access slot 324. Guides 414, 415, 416, and 417 abut the cabinet frame.

Hinge 100 provides adjustment in three directions after mounting without removing or loosening the mounting hardware. One direction of adjustment is the depth movement of the cabinet door. This adjustment is required when the inside face of the door does not lay flush with the cabinet frame thus impeding the opening and closing action. To effect the depth adjustment, depth adjustment cam screw 130 is rotated. As depth adjustment cam screw 130 is rotated, the camming portion of depth adjustment cam screw 130 abuts, rotates within, and slides along depth adjustment slot 234 while the offset portion of depth adjustment cam screw 130 rotates within depth adjustment hole 328. During manufacture, the offset portion of depth adjustment cam screw 130 is inserted through access hole 420 and shot peened or deformed so as to prevent depth adjustment cam screw 130 from escaping depth adjustment hole 328. Rotation of depth adjustment cam screw 130 causes hinge arm 104 and overlay plate 124 to move together in direction 174 relative to adjustment plate 126 and mounting plate 128 and the cabinet frame. Once the desired position is achieved, rotation of depth adjustment cam screw 130 is ceased.

Another direction of adjustment is the horizontal or "overlay" adjustment of the cabinet door. This adjustment is required when the vertical edges of the cabinet door do not align with the vertical edges of the cabinet frame or the vertical edges of an adjacent cabinet door or drawer. To effect the overlay adjustment, overlay adjustment cam screw 110 is rotated. As overlay adjustment cam screw 110 is rotated, the camming portion of overlay adjustment cam screw 110 abuts, rotates within, and slides along overlay adjustment slot 222 while the offset portion of overlay adjustment cam screw 110 rotates within overlay adjustment hole 610. During manufacture, the offset portion of overlay adjustment cam screw 110 is inserted into overlay adjustment hole 610 and shot peened or deformed so as to prevent removal. Rotation of overlay adjustment cam screw 110 causes hinge arm 104 to move in direction 176 relative to hinge body 108 and the cabinet frame. Once the desired position is achieved, rotation of overlay adjustment cam screw 110 is ceased.

Another direction of adjustment is the vertical adjustment of the cabinet door. This adjustment is required when the horizontal edges of the cabinet door do not align with the horizontal edges of the cabinet frame or the horizontal edges of an adjacent cabinet door or drawer. To effect the vertical adjustment, vertical adjustment cam screw 132 is rotated. As vertical adjustment cam screw 132 is rotated, the camming portion of vertical adjustment cam screw 132 abuts, rotates within, and slides along vertical adjustment slot 326 while the offset portion of vertical adjustment cam screw 132 rotates within vertical adjustment hole 422. During manufacture, the offset portion of vertical adjustment cam screw 132 is shot peened or deformed to prevent removal of vertical adjustment cam screw 132 from vertical adjustment hole 422. Rotation of vertical adjustment cam screw 132 causes hinge arm 104, overlay plate 124, and adjustment plate 126 to move together in direction 172 relative to mounting plate 128 and the cabinet frame. Once the desired position is achieved, rotation of vertical adjustment cam screw 132 is ceased.

During a closing motion, spring 112 provides a closing bias. The closing bias provided by spring 112 is a result of spring legs 184 and 185 biasing hinge arm 104 via cam portions 602 and 603. Damper 162 opposes the closing bias and mitigates the closing speed of the cabinet door so as to lessen the impact of the cabinet door on the cabinet frame. Damper 162 is secured within hinge cup 102 by damper cover 170. As the cabinet door closes, abutment section 606 abuts face 810 and forces cylinder 164 towards rear wall 155 while piston rod 168 and damper cover 170 remain stationary relative to hinge cup 102. Since piston rod 168 abuts rear wall 155, as cylinder 164 moves through opening 710, piston head 166 moves through the fluid in cylinder 164 to provide the soft-close functionality. The guide portion of damper cover 170 directs the cylinder 164 so that it may slide longitudinally along axis 158 between sides 702 and 703 guided by guide ridges 712, 713, 716, and 717 through opening 710.

It will be appreciated by those skilled in the art that changes could be made to the embodiments described above without departing from the broad inventive concept thereof. It is understood, therefore, that this disclosure is not limited to the particular embodiments disclosed, but it is intended to cover modifications within the spirit and scope of the present disclosure as defined by the appended claims.

The invention claimed is:

1. A soft-close hinge for pivotally connecting a cabinet door to a cabinet frame comprising:

a hinge cup pivotally connected to a hinge arm, the hinge cup having a first side wall and a second side wall defining an interior, a first tab extending into the interior from the first side wall;

a second tab extending into the interior from the second side wall;

a hinge body adjustably connected to the hinge arm;

a damper cover permanently engaged with the first tab and the second tab;

a damper, secured in the interior and adjacent the damper cover, that is positioned to operatively engage the hinge arm through a sliding engagement with an angled cylinder face;

a spring, held adjacent the hinge cup, extending through the first side wall and the second side wall and biasing the hinge cup toward the hinge arm; and, wherein a position of the hinge arm relative to the cabinet frame is adjustable in a first direction, a second direction, and a third direction.

2. The soft-close hinge of claim 1 wherein the hinge body further comprises:

an overlay plate adjustably connected to the hinge arm;

an adjustment plate adjustably connected to the overlay plate; and, a mounting plate adjustably connected to the adjustment plate.

3. The soft-close hinge of claim 1 wherein the spring further comprises:

a loop section held against an exterior of the hinge cup;

a first coil section connected to the loop section;

a second coil section connected to the loop section;

a first leg section extending from the first coil section to the interior; and, a second leg section extending from the second coil section to the interior.

4. The soft-close hinge of claim 1 wherein the hinge body further comprises:

an overlay plate adjustably connected to the hinge arm by an overlay cam screw;

an adjustment plate adjustably connected to the overlay plate by a depth cam screw;

a mounting plate adjustably connected to the adjustment plate by a vertical cam screw;

wherein rotation of the overlay cam screw causes the first direction to be a horizontal direction;

wherein rotation of the depth cam screw causes the second direction to be a depth direction; and, wherein rotation of the vertical cam screw causes the third direction to be a vertical direction.

5. The soft-close hinge of claim 1 wherein the hinge body further comprises:

an overlay plate having a first planar surface aligned with a second planar surface;

a first access opening in the first planar surface and a second access opening in the second planar surface;

a depth adjustment slot in the first planar surface;

an adjustment plate connected to the overlay plate at the first planar surface by a depth cam screw; and, a mounting plate connected to the adjustment plate.

6. The soft-close hinge of claim 1 wherein the hinge body further comprises:

an overlay plate having a first side disposed opposite a second side;

a first slot in the first side and a second slot in the second side;

an adjustment plate having a third side disposed opposite a fourth side;

a first block extending from the third side and a second block extending from the fourth side, whereby the first block is slidably engaged with the first slot and the second block is slidably engaged with the second slot; and, a mounting plate connected to the adjustment plate.

7. The soft-close hinge of claim 1 wherein the hinge body further comprises:

an overlay plate, having an overlay slot and a depth slot, connected to the hinge arm by an overlay cam screw rotatable in the overlay slot;

an adjustment plate, having a depth hole and a vertical slot, connected to the overlay plate by a depth cam screw rotatable in the depth slot and the depth hole;

a mounting plate, having a vertical hole, connected to the adjustment plate by a vertical cam screw rotatable in the vertical slot and the vertical hole;

wherein rotation of the overlay cam screw adjusts the position of the hinge arm relative to the cabinet frame in a horizontal direction;

wherein rotation of the depth cam screw adjusts the position of the hinge arm relative to the cabinet frame in a depth direction; and, wherein rotation of the vertical cam screw adjusts the position of the hinge arm relative to the cabinet frame in a vertical direction.

8. The soft-close hinge of claim 1 wherein the damper further comprises:

a cylinder, adjacent the hinge arm and the hinge cup, slidable with respect to the hinge cup and the damper cover; and, a piston rod extending from the cylinder, passing through the damper cover, and abutting the hinge cup.

9. A soft-close hinge for pivotally connecting a cabinet door to a cabinet frame comprising:

a hinge cup pivotally connected to a hinge arm, the hinge cup having a first side wall and a second side wall defining an interior;

a first tab extending into the interior from the first side wall;

a second tab extending into the interior from the second side wall;

a hinge body adjustably connected to the hinge arm;

a damper cover permanently engaged with the first tab and the second tab;

a damper, secured in the interior and adjacent the damper cover, that is positioned to operatively engage the hinge arm through a sliding engagement with an angled cylinder face;

a spring, held adjacent the hinge cup, extending through the first side wall and the second side wall and biasing the hinge cup toward the hinge arm;

wherein a position of the hinge arm relative to the cabinet frame is adjustable in a first direction, a second direction, and a third direction;

wherein the damper cover further comprises an engagement section having a first cutout engaged with the first tab and a second cutout engaged with the second tab; and, a guide section having a first set of ridges slidably engaged with a set of flanges extending from the damper and a second set of ridges slidably engaged with a curved section of the damper.

10. The soft-close hinge of claim 9 wherein the hinge arm further comprises:

a first end having a cylindrical sleeve connected between a set of curved cam portions;

a second end having a planar attachment section and defining an overlay hole;

the hinge body having a pocket and an overlay slot;

the attachment section slidably engaged with the pocket; and, an overlay cam screw adjustably connecting the hinge arm to the hinge body and rotatable within the overlay hole and the overlay slot.

11. The soft-close hinge of claim 9 wherein:

the hinge cup is configured to be mounted to the cabinet door;

the hinge body is configured to be mounted to the cabinet frame with a wood screw; and, the adjustment of the position of the hinge arm relative to the cabinet frame is accomplished without loosening the wood screw.

12. A compact, soft-close hinge for pivotally connecting a cabinet door to a cabinet frame comprising:

a hinge cup defining an interior and having a set of tabs extending into the interior, the hinge cup pivotally connected to a hinge arm;

an overlay plate adjustably connected to the hinge arm by an overlay cam screw;

an attachment section of the hinge arm slidably engaged with a pocket extending from the overlay plate;

an adjustment plate adjustably connected to the overlay plate by a depth cam screw;

a mounting plate adjustably connected to the adjustment plate by a vertical cam screw;

a damper secured in the interior by a damper cover, the damper having a piston rod extending from a cylinder, the cylinder adjacent the hinge arm;

the damper cover fixedly engaged with the set of tabs;

a set of ridges extending from the damper cover and slidably engaged with the cylinder;

a spring seated adjacent the hinge cup and biasing the hinge cup toward the hinge arm;

wherein a position of the hinge arm relative to the mounting plate is adjustable in a first direction, a second direction, and a third direction.

13. The compact, soft-close hinge of claim 12 further comprising:

the hinge arm defines an overlay adjustment hole positioned in the attachment section;

the overlay plate defines a depth adjustment slot and an overlay adjustment slot positioned in the pocket;

the adjustment plate defines a depth adjustment hole and a vertical adjustment slot;

the mounting plate defines a vertical adjustment hole;

the overlay cam screw rotatably engaged with the overlay adjustment hole and the overlay adjustment slot;

the depth cam screw rotatably engaged with the depth adjustment hole and the depth adjustment slot;

the vertical cam screw rotatably engaged with the vertical adjustment hole and the vertical adjustment slot;

wherein rotation of the overlay cam screw adjusts the position of the hinge arm relative to the mounting plate in a horizontal direction;

wherein rotation of the depth cam screw adjusts the position of the hinge arm relative to the mounting plate in a depth direction; and, wherein rotation of the vertical cam screw adjusts the position of the hinge arm relative to the mounting plate in a vertical direction.

14. A compact, soft-close hinge for pivotally connecting a cabinet door to a cabinet frame comprising:

a hinge cup defining an interior and having a set of tabs extending into the interior, the hinge cup pivotally connected to a hinge arm;

an overlay plate adjustably connected to the hinge arm by an overlay cam screw;

an attachment section of the hinge arm slidably engaged with a pocket extending from the overlay plate;

an adjustment plate adjustably connected to the overlay plate by a depth cam screw;

a mounting plate adjustably connected to the adjustment plate by a vertical cam screw;

a damper secured in the interior by a damper cover, the damper having a piston rod extending from a cylinder, the cylinder adjacent the hinge arm;

the damper cover permanently engaged with the set of tabs;

a first set of ridges extending from the damper cover;

a second set of ridges, opposite the first set of ridges, extending from the damper cover;

a spring seated adjacent the hinge cup and biasing the hinge cup toward the hinge arm;

wherein a position of the hinge arm relative to the mounting plate is adjustable in a first direction, a second direction, and a third direction;

wherein the damper cover further comprises an engagement section having a first cutout engaged with the first tab and a second cutout engaged with the second tab;

whereby the first set of ridges is slidably engaged with a first set of flanges extending from the damper; and, whereby the second set of ridges is slidably engaged with a second set of flanges, opposite the first set of flanges, extending from the damper.

15. A method of damping the closing movement of a compact hinge having a hinge cup pivotally connected to a hinge arm, an overlay plate connected to the hinge arm by an overlay cam screw, an adjustable plate connected to the overlay plate by a depth cam screw, a mounting plate connected to the adjustable plate by a vertical cam screw, a damper cover permanently engaged with a set of tabs extending from the hinge cup, a damping cylinder slidable within the hinge cup and positioned by the damper cover, and a spring held adjacent the hinge cup and biasing the hinge cup toward the hinge arm comprising:

providing a closing force to the compact hinge to begin the closing movement;

abutting the cylinder with the hinge arm;

moving the cylinder through the hinge cup and adjacent the hinge cover; and, whereby closing speed of the compact hinge is controlled.

16. The method of claim 15 further comprising:

guiding movement of the cylinder with a set of ridges extending from the damper cover.

17. The method of claim 15 wherein the hinge arm further includes a set of cam portions and the spring further includes a set of legs, the method further comprising:

biasing the set of legs toward the set of cam portions.

18. The method of claim 15 further comprising:

rotating the vertical cam screw to adjust a vertical position of the hinge arm relative to the mounting plate.

19. The method of claim 15 further comprising:

rotating the depth cam screw to adjust a depth position of the hinge arm relative to the mounting plate.

20. The method of claim 15 further comprising:

rotating the overlay cam screw to adjust a horizontal position of the hinge arm relative to the mounting plate.

* * * * *